US009386875B2

(12) United States Patent
Clifton

(10) Patent No.: US 9,386,875 B2
(45) Date of Patent: Jul. 12, 2016

(54) COMBINATION SHOE HORN AND SOCK DONNING AND DOFFING APPARATUS

(71) Applicant: Garry Clifton, Park City, UT (US)

(72) Inventor: Garry Clifton, Park City, UT (US)

( * ) Notice: Subject to any disclaimer, the term of this patent is extended or adjusted under 35 U.S.C. 154(b) by 0 days.

(21) Appl. No.: 14/297,708

(22) Filed: Jun. 6, 2014

(65) Prior Publication Data

US 2015/0083761 A1 Mar. 26, 2015

Related U.S. Application Data

(60) Provisional application No. 61/882,978, filed on Sep. 26, 2013.

(51) Int. Cl.
*A47G 25/90* (2006.01)
*A47G 25/82* (2006.01)

(52) U.S. Cl.
CPC ..... *A47G 25/908* (2013.01); *A47G 25/82* (2013.01); *A47G 25/905* (2013.01)

(58) Field of Classification Search
CPC ..... A47G 25/82; A47G 25/80; A47G 25/90; A47G 25/905
See application file for complete search history.

(56) References Cited

U.S. PATENT DOCUMENTS

| | | | | | |
|---|---|---|---|---|---|
| 1,424,030 | A * | 7/1922 | Peck | 223/118 |
| 2,820,274 | A * | 1/1958 | Ballentine | 24/698.3 |
| 2,939,618 | A * | 6/1960 | Mangels | 223/113 |
| 3,501,073 | A * | 3/1970 | Breithor | 223/118 |
| D302,490 | S | 8/1989 | Denney | |
| 5,392,800 | A * | 2/1995 | Sergi | 135/65 |
| D371,231 | S * | 7/1996 | Traber et al. | D2/642 |
| 5,924,610 | A * | 7/1999 | Willemin | 223/112 |
| 5,927,573 | A | 7/1999 | Votino | |
| 5,961,012 | A * | 10/1999 | Bucher | 223/119 |
| 5,974,701 | A * | 11/1999 | Busch | 36/138 |
| 6,283,342 | B1 * | 9/2001 | Wilkerson | 223/112 |
| 6,328,048 | B1 * | 12/2001 | Rivera, Sr. | 135/66 |
| 6,698,630 | B1 * | 3/2004 | Maguire | 223/118 |
| 6,942,129 | B2 | 9/2005 | Ferraioli | |
| 7,337,933 | B1 | 3/2008 | Klinberg | |
| 7,975,886 | B2 | 7/2011 | McAllister | |
| 2002/0139819 | A1 * | 10/2002 | Ferraioli | 223/111 |
| 2008/0217365 | A1 * | 9/2008 | Fox | 223/111 |
| 2011/0226821 | A1 * | 9/2011 | McGuire | 223/118 |
| 2012/0211532 | A1 | 8/2012 | Santos | |

* cited by examiner

*Primary Examiner* — Shaun R Hurley
*Assistant Examiner* — Andrew W Sutton
(74) *Attorney, Agent, or Firm* — Daniel Boudwin; Global Intellectual Property Agency, LLC

(57) ABSTRACT

Disclosed is a combination shoe horn and sock donning and doffing apparatus. The device includes an elongated rod that is composed of anodized aluminum so that it is lightweight and resistant to breaking. The rod includes a sock hook attached to a first end and a shoe horn attached to a second end. The sock hook is generally U-shaped and includes two terminal ends with a rubber tip. The shoe horn is oval shaped and has a curvature so as to follow substantially the contour of the back of a shoe. The rod also includes handle portions with a non-slip padding thereon. The device enables a user to don or remove footwear without bending over. In this way, the present invention is ideal for use by users who have limited mobility and cannot bend at the waist or the knees.

9 Claims, 2 Drawing Sheets

COMBINATION SHOE HORN AND SOCK DONNING AND DOFFING APPARATUS

CROSS REFERENCE TO RELATED APPLICATION

This application claims the benefit of U.S. Provisional Application No. 61/882,978 filed on Sep. 26, 2013. The above identified patent application is herein incorporated by reference in its entirety to provide continuity of disclosure.

BACKGROUND OF THE INVENTION

1. Field of the Invention

The present invention relates to a combination shoe horn and sock donning and doffing apparatus. More specifically, the present invention pertains to an improved shoe horn and sock donning device that comprises an elongated handle to assist individuals with donning and removing footwear without bending over. The device is lightweight and durable, and comprises a smooth exterior surface so as to prevent any injuries to the user during use.

Many individuals have limited mobility due to a back surgery, hip fractures, and hip replacement surgery. These individuals are discouraged from bending at the waist to prevent over-bending and injuring the repaired joint and aggravating recovery. For instance, individuals who undergo hip surgeries are especially at risk for dislocating their hip when bending forward at the waist or pulling the legs up past the waist. Accordingly, bending forward can worsen hip injuries.

Similarly, back injuries including sciatica, herniated disc, spinal stenosis, strain, or neuropathy, as well as back surgeries can limit movement. When bending forward at the waist, the front of the vertebrae squeeze closer together, opening the space between the back of each vertebrae. Bad posture or overextension can cause the discs to move backward and begin to deteriorate. When the disc is moved far enough, it can touch the nerves or apply pressure on the spinal cord, causing pain and discomfort.

Additionally, various medical conditions such as rheumatic diseases, weight gain, and heart conditions can limit individuals from bending at the waist or other joints. Rheumatic diseases are usually caused by inflammation, swelling, and pain in the joints or muscles. Some rheumatic diseases such as osteoarthritis are the result of wear and tear to the joints. Other rheumatic diseases, such as rheumatoid arthritis, happen when the immune system becomes hyperactive and attacks the linings of joints, causing joint pain, swelling, and destruction. As a result, people with rheumatic diseases have difficulty sitting or bending over.

Obesity or significant weight gain can also cause limited mobility. While some individuals may experience temporary weight gain due to conditions such as pregnancy, every pound of body weight yields five pounds of force on the knee, causing joint pain. Being overweight also increases the likelihood of rheumatic diseases and heart conditions. As such, performing everyday tasks such as donning and removing footwear, which would require an individual to bend over, can be difficult for those who are overweight or for those who suffer from the aforementioned medical conditions. Therefore, a device that facilitates individuals with limited mobility in performing everyday tasks that would require the individuals to bend over is desired.

The present invention is a combination shoe horn and sock donning and doffing apparatus designed to facilitate a user with donning and removing footwear without bending over. The present invention comprises an elongated rod having a first end that is attached to a sock hook and a second end that is attached to a shoe horn. The elongated rod is dimensioned so as to allow the user to reach his or her foot with the device while standing or sitting. The sock hook is adapted to pull on or remove a sock, compression sock, or stocking. The shoe horn keeps the opening of a shoe open while providing a smooth surface for the foot and the heel to move. The present invention is suitable for use by individuals with limited mobility, but may also be used by individuals with a full range of mobility.

2. Description of the Prior Art

Devices have been disclosed in the prior art that relate to shoe horns and sock donning devices. These include devices that have been patented and published in patent application publications, and generally relate to shoe horns with an elongated handle and a sock donning system with a plate and/or a hook. Some of these devices disclose a shoe horn with a tongue portion and a shoe horn portion for widening the opening of a shoe. Other devices disclose a shoe horn with a curved portion that is shaped to follow the contours of the back of a shoe. These devices, however, do not disclose a combination shoe horn and sock donning and doffing apparatus. The foregoing is a list of devices deemed most relevant to the present disclosure, which are herein described for the purposes of highlighting and differentiating the unique aspects of the present invention, and further highlighting the drawbacks existing in the prior art.

Specifically, U.S. Pat. No. 5,927,573 to Votino discloses a shoe horn apparatus for use by handicapped individuals with limited mobility. The shoe horn comprises an elongated rod with an upper and a lower end. The upper end comprises a handle and the lower end comprises a horizontal support with a first arm and a second arm. The first arm includes a tongue that holds a front part of the shoe open, while the second arm includes a shoe horn that provides a smooth surface for the foot and the heel to move into the shoe. While the Votino device assists a handicapped individual with putting on a shoe, the Votino device fails to disclose a device that assists a user with putting on a sock. The present invention provides a sock hook that is adapted to pull a sock on or off of the user's foot.

U.S. Design Pat. No. D302490 to Denney discloses a shoe horn having a handle portion and a shoe horn portion. The handle portion comprises padding thereon to provide comfort to the user when holding the device. Similarly, U.S. Published Patent Application Number 2012/0211532 to Santos discloses a shoe horn with a handle portion and a shoe horn portion. The handle portion comprises an aperture thereon so that it can be hung when not in use. The foregoing Denney and Santos devices are directed toward a long handled shoe horn with a handle portion. While the devices of Denney and Santos assist a user in donning a pair of shoes by reducing bending and straining by users lacking joint mobility, the devices are not operable to assist the user in donning a pair of socks.

U.S. Pat. No. 6,942,129 to Ferraioli discloses a footwear donning device comprising an elongated rod having an upper and a lower end. The lower end comprises a carrier plate with curved side walls. Each of the side walls include a hook for securing a portion of an opening of the sock thereon. In use, a portion of the carrier plate is inserted into the sock to keep the sock open. Thereafter, a user can slide his or her foot on the carrier plate and into the sock. The upper end of the device comprises a snare that can be used to remove the sock from the user's foot. The Ferraioli device, however, do not include a rubber coating over the snare. In contrast, the present invention comprises a sock hook that is adapted to pull a sock on or off of the user's foot. The sock hook comprises a rubber coating to prevent the user from tearing skin.

U.S. Pat. No. 7,337,933 to Klinberg discloses a pocket shoe horn with a telescopic handle having a plurality of telescoping sleeves. The shoe horn portion is pivotally attached to an outer end of the inner most sleeve. While the Klinberg device provides a shoe horn that can extend in length, the purpose and intent of the Klinberg device differ from the present invention. The Klinberg device comprises a telescopic handle so that it may be stored in a compact configuration when not in use. Because the handle is easily collapsible and expansible, it is prone to snapping or breaking. In contrast, the purpose of the present invention is to prevent the user from bending over excessively when donning or removing footwear. Because the present invention is primarily designed for individuals with limited mobility, it is composed of a light weight anodized aluminum that is resistant to breaking.

Finally, U.S. Pat. No. 7,975,886 to McAllister discloses a sock donning system comprising a pair of identical grasping poles with remotely operable clasps at their distal ends. The clasps are adapted to hook a pair of loops disposed on a sock or a stocking. Once the clasps are secured through the loops, the sock is pulled onto the user's foot. While the sock donning system of McAllister enables users of limited mobility to don socks, stockings, and similar footwear without need for excessive bending at the waist and/or knee, the grasping poles are limited for use with socks or stockings having a pair of loops thereon. In contrast, the present invention may be used with any type of footwear, socks, or stockings, thereby increasing versatility of the device.

The devices disclosed in the prior art have several known drawbacks. These devices do not provide a dual function and are limited for use to put on either a sock or a shoe. The present invention overcomes these limitations by providing a multipurpose device that can help a user put on or take off socks and shoes, and that further protects the user's skin during use. It is therefore submitted that the present invention is substantially divergent in design elements from the prior art, and consequently it is clear that there is a need in the art for an improvement to shoe horns and sock donning devices. In this regard, the instant invention substantially fulfills these needs.

SUMMARY OF THE INVENTION

In view of the foregoing disadvantages inherent in the known types of shoe horns and sock donning devices now present in the prior art, the present invention provides a new and improved combination shoe horn and sock donning and doffing apparatus wherein the same can be utilized for facilitating users with limited mobility put on or take off footwear.

It is therefore an object of the invention to provide a new and improved combination shoe horn and sock donning and doffing apparatus that has all of the advantages of the prior art and none of the disadvantages.

Another object of the present invention is to provide a new and improved combination shoe horn and sock donning and doffing apparatus that enables users of limited mobility to don socks, compression socks, shoes, and other types of footwear without the need for excessive bending at the waist and/or knee.

Yet another object of the present invention is to provide a new and improved combination shoe horn and sock donning and doffing apparatus that is composed of lightweight and durable material.

Still yet another object of the present invention is to provide a new and improved combination shoe horn and sock donning and doffing apparatus having a hooking portion with a rubber coating to help prevent the user from tearing or cutting his or her skin.

Other objects, features, and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein the numeral annotations are provided throughout.

DETAILED DESCRIPTION OF THE INVENTION

Figure 1:
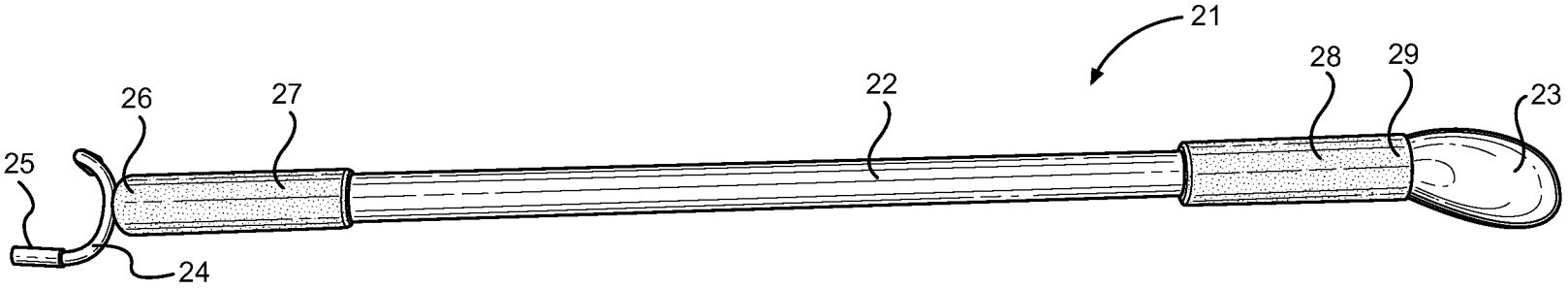
FIG. 1 shows a perspective view of the present invention.

References are made herein to the attached drawings. Like reference numerals are used throughout the drawings to depict like or similar elements of the combination shoe horn and sock donning and doffing apparatus. For the purposes of presenting a brief and clear description of the present invention, the preferred embodiment will be discussed as used to facilitate users with limited mobility put on or take off socks, footwear, and the like. The figures are intended for representative purposes only and should not be considered to be limiting in any respect.

Referring now to FIG. 1, there is shown a perspective view of the present invention. The present invention comprises a combination shoe horn and sock donning and doffing apparatus 21 that comprises an elongated rod 22 having a first end 26 and a second end 29. The rod 22 is dimensioned so as to allow a user to reach his or her foot with the device while in a standing or sitting position. The rod 22 is composed of a light weight durable material, preferably anodized aluminum. In this way the apparatus 21 is both easy to hold or carry and is durable for long term use. The rod 22 is an elongated cylinder with a circular cross section having a diameter that is uniform over its length. In one embodiment, the rod 22 may be hollow so as to create an elongated cavity therein. The hollow interior of the rod 22 would help to further reduce or minimize the overall weight of the apparatus 21.

Each of the first 26 and second 29 ends comprise a handle portion 27, 28, respectively. Each of the handle portions 27, 28 is tubular in shape and wraps around the first 26 and second 29 ends of the rod, respectively. The handle portions 27, 28 comprise a non-slip padded surface that is composed of foam, gel, rubber or the like. The padded surface facilitates holding the device by providing users with an improved grip. The present invention comprises a handle portion on each of the ends 26, 29 of the rod 22 so that the user can properly grip the device whether the first end 26 or the second end 29 is utilized.

The first end 26 further comprises a sock hook 24 that is substantially U-shaped. In an exemplary embodiment, the sock hook 24 is attached to the first end 26 via a fastener such as a screw and an anchor. The screw and the anchor may be attached to a plug or a cork that is disposed in the hollow cavity of the rod 22 at the first end 26. The plug may be a cylindrical structure with a circular cross section having a diameter that is slightly smaller than the diameter of the rod 22 so that it is adapted to tightly fit in the hollow cavity of the rod 22. The plug may be composed of rubber, cork, or other suitable material. The anchor may be a screw anchor or other suitable anchor means such as a washer and locking nut combination. In some embodiments, the sock hook 24 and the rod 22 may be unitary in structure so as to eliminate the need for a fastener.

The second end 29 of the rod 22 comprises a shoe horn 23 attached thereto. The shoe horn 23 is attached to the rod 22 by one or more fasteners, such as bolts, pins, rivets, or other suitable fasteners. Similar to the first end 26, the second end 29 may also comprise a plug or a cork that has a circular cross section with a diameter that is slightly smaller than the diameter of the rod 22. The plug or cork is adapted to tightly fit in the hollow cavity of the rod 22 so that it is secured in place and prevented from moving further into the rod 22 when connected to one or more fasteners that attaches the shoe horn 23. In some embodiments, the shoe horn 23 and the rod 22 may be unitary in structure so as to eliminate the need for a fastener.

Figure 2:
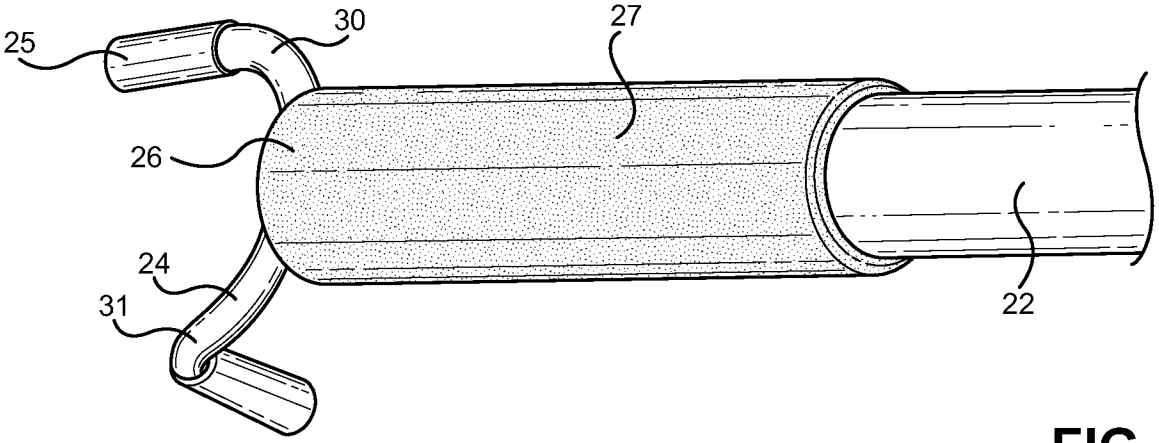
FIG. 2 shows a close up view of the sock hook of the present invention.

Referring now to FIG. 2, there is shown a close up view of the first end 26 of the rod 22 having a sock hook 24 attached thereto. The sock hook 24 is preferably composed of metal such as anodized aluminum. The sock hook comprises a first end 30 and a second end 31 that point away from the rod 22 so as to substantially form a U-shape. The first end 30 is positioned generally parallel to the rod 22 while the second end 31 is positioned perpendicularly to the rod 22. Each of the first 30 and second 31 ends comprises a rubber tip 25 thereon. The rubber tip 25 provides a smooth surface that prevents a user from cutting, scraping, or tearing his or her skin when using the device. This is particularly advantageous for users with diabetes or peripheral neuropathies that have reduced or impaired sensation and are especially vulnerable to wounds.

The first end 30 of the sock hook 24 is adapted to remove socks, stockings, compression socks, or other similar footwear off of the user's foot. The first end 30 may be inserted between a sock and the user's leg to pull down the sock. Because the rod 22 is elongated, the user can remove the sock without bending at the waist or the knee. Alternatively, the second end 31 of the sock hook 24 is adapted to don socks, stocking, compression socks, or other similar footwear onto the user's foot. The second end 31 can hook onto the opening of a sock and hold the sock open so that the user can insert his or her foot therein. Once the user's foot is positioned within the opening of the sock, the second end 31 can be used to pull the sock onto the user's foot and leg.

Figure 3:
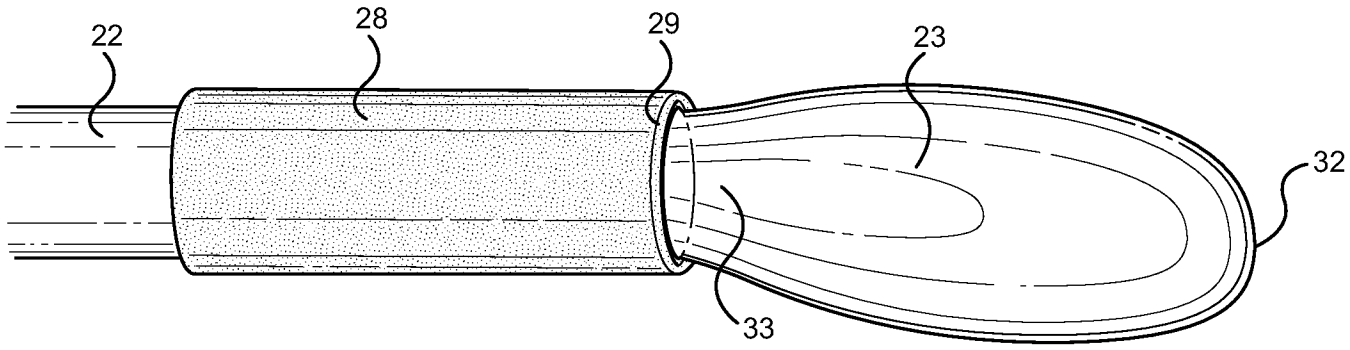
FIG. 3 shows a close up view of the shoe horn of the present invention.

Referring now to FIG. 3, there is shown a close up view of the second end 29 of the rod 22 having a shoe horn 23 attached thereto. The shoe horn 23 is also preferably composed of metal such as anodized aluminum. The sock hook comprises an upper end 32 and a lower end 33 that is attached to the second end 29 of the rod 22. The shoe horn 23 is generally oval in shape with a defined perimeter. The perimeter comprises a rounded edge to prevent the shoe horn 23 from cutting or scraping the user's foot. The shoe horn 23 has a curvature so as to follow substantially the contour of the back of a shoe.

The shoe horn 23 is adapted to assist the user with putting on a shoe more easily. Alternatively, the shoe horn 23 may be used to remove a shoe. The shoe horn 23 keeps the back of the shoe open and provides a smooth surface on which the foot and the heel can move so that the foot is guided into the shoe. The present invention is suitable for use with various types of shoes. Without limitation, the shoe horn 23 may be used with sneakers, dress shoes, heels, and boots, among others.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above descriptions then, it is to be realized that the optimum dimensional relationships for the parts of the invention, to include variations in size, materials, shape, form, function, and manner of operation, assembly and use, are deemed readily apparent and obvious to one skilled in the art, and all equivalent relationships to those illustrated in the drawings and described in the specifications are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A combination shoe horn and sock donning and doffing apparatus, comprising:

an elongated rod having a first end and a second end;

said first end of said elongated rod comprising a sock hook that is U-shaped, wherein said sock hook includes a first end and a second end extending therefrom;

said sock hook having a first sock hook tip and second sock hook tip;

wherein the first sock hook tip extends from the first end of the sock hook and is positioned parallel relative to said elongated rod;

wherein the second sock hook tip extends perpendicularly from the second end of the sock;

wherein the second sock hook tip is perpendicular and non-planar to the first sock hook tip;

said second end of the elongated rod comprising a shoe horn;

at least one handle portion along a portion of said elongated rod.

2. The combination shoe horn and sock donning and doffing apparatus of claim 1, wherein said rod is composed of anodized aluminum.

3. The combination shoe horn and sock donning and doffing apparatus of claim 1, wherein said at least one handle portion comprises:

a first handle portion and a second handle portion;

wherein said first handle portion is disposed on said first end;

wherein said second handle portion is disposed on said second end.

4. The combination shoe horn and sock donning and doffing apparatus of claim 1, wherein the first hook tip and the second sock hook tip comprise rubber tips.

5. The combination shoe horn and sock donning and doffing apparatus of claim 1, wherein said at least one handle is tubular in shape.

6. The combination shoe horn and sock donning and doffing apparatus of claim 1, wherein said handle is composed of foam.

7. The combination shoe horn and sock donning and doffing apparatus of claim 1, wherein said shoe horn comprises an oval shape and includes a concave depression adapted to receive a user's heel.

8. The combination shoe horn and sock donning and doffing apparatus of claim 1, wherein said elongated rod comprises a hollow interior.

9. The combination shoe horn and sock donning and doffing apparatus of claim 1, wherein said elongated rod is cylindrical.

* * * * *